US009476366B2

(12) United States Patent
Tanaka et al.

(10) Patent No.: US 9,476,366 B2
(45) Date of Patent: Oct. 25, 2016

(54) CONTROL DEVICE AND CONTROL METHOD FOR VARIABLE COMPRESSION RATIO INTERNAL COMBUSTION ENGINES

(71) Applicant: NISSAN MOTOR CO., LTD., Yokohama-shi, Kanagawa (JP)
(72) Inventors: Yoshiaki Tanaka, Fujisawa (JP); Ryosuke Hiyoshi, Atsugi (JP); Yusuke Takagi, Hadano (JP); Katsutoshi Nakamura, Atsugi (JP)
(73) Assignee: NISSAN MOTOR CO., LTD., Yokohama-shi, Kanagawa (JP)

( * ) Notice: Subject to any disclaimer, the term of this patent is extended or adjusted under 35 U.S.C. 154(b) by 0 days.
(21) Appl. No.: 14/421,241
(22) PCT Filed: Jun. 3, 2013
(86) PCT No.: PCT/JP2013/065347
§ 371 (c)(1),
(2) Date: Feb. 12, 2015
(87) PCT Pub. No.: WO2014/027497
PCT Pub. Date: Feb. 20, 2014
(65) Prior Publication Data
US 2015/0204251 A1 Jul. 23, 2015
(30) Foreign Application Priority Data
Aug. 13, 2012 (JP) ..... 2012-179165
(51) Int. Cl.
*F02D 15/00* (2006.01)
*F02D 37/02* (2006.01)
(Continued)
(52) U.S. Cl.
CPC ..... *F02D 15/00* (2013.01); *F01M 9/06* (2013.01); *F01M 11/12* (2013.01); *F02B 75/045* (2013.01);
(Continued)
(58) Field of Classification Search
CPC ..... F02D 15/02; F02D 15/00; F02D 15/04; F02B 75/048; F02B 75/04; F02B 75/045
USPC ..... 123/196 R, 196 W, 48 R, 48 A, 48 AA, 123/48 B, 78 R, 78 A, 78 BA, 78 E, 78 F
See application file for complete search history.

(56) References Cited

U.S. PATENT DOCUMENTS 7,347,111 B2 * 3/2008 Brone ..... G01N 1/20 73/863.21
7,357,111 B2 * 4/2008 Maezuru ..... F01M 9/06 123/196 R
(Continued)

FOREIGN PATENT DOCUMENTS

JP 2003-129817 A 5/2003
JP 2010-112279 A 5/2010
(Continued)

*Primary Examiner* — Lindsay Low
*Assistant Examiner* — Long T Tran
(74) *Attorney, Agent, or Firm* — Drinker Biddle & Reath LLP

(57) ABSTRACT

There are provided a variable compression-ratio mechanism (20) capable of varying an engine compression ratio in accordance with a rotational position of a control shaft (24); a speed reducer (44) configured to reduce in speed a rotational power of an actuator and transmit the speed-reduced rotational power to the control shaft (24); and a speed-reducer accommodating case (43) accommodating the speed reducer (44). An input shaft of the speed reducer (44) which is connected to the actuator has a shaft center line extending along a horizontal direction, and at least a part of the input shaft is kept under a lubricating oil retained in the speed-reducer accommodating case (43). The input shaft of the speed reducer (44) is swung by a predetermined swing angle to avoid inadequate lubrication of the input shaft of the speed reducer (44), during an operating state where the engine compression ratio is maintained constant.

13 Claims, 5 Drawing Sheets

(51) Int. Cl.

| | |
|---|---|
| ***F01M 9/06*** | (2006.01) |
| ***F01M 11/12*** | (2006.01) |
| ***F02D 15/02*** | (2006.01) |
| ***F02B 75/04*** | (2006.01) |
| *F02D 41/30* | (2006.01) |
| *F02D 41/00* | (2006.01) |

(52) U.S. Cl.
CPC ..... *F02B 75/048* (2013.01); *F02D 15/02* (2013.01); *F02D 37/02* (2013.01); *F02D 41/0002* (2013.01); *F02D 41/30* (2013.01)

(56) References Cited

U.S. PATENT DOCUMENTS 7,509,932 B2 * 3/2009 Hara ..... F02D 35/023 123/90.15
7,574,986 B2 * 8/2009 Ishikawa ..... F02D 15/02 123/78 BA
7,802,544 B2 * 9/2010 Kamada ..... F02B 75/048 123/197.4
2007/0175420 A1 * 8/2007 Ishikawa ..... F02D 15/02 123/78 BA
2008/0283008 A1 * 11/2008 Hiyoshi ..... F02B 75/048 123/90.17
2010/0206270 A1 * 8/2010 Rabhi ..... F01B 9/047 123/48 B
2013/0327302 A1 * 12/2013 Hiyoshi ..... F02B 75/04 123/48 R

FOREIGN PATENT DOCUMENTS

JP 2010-151088 A 7/2010
JP 4533856 B2 9/2010
JP 2011-169152 A 9/2011

* cited by examiner (b)

(a)

CONTROL DEVICE AND CONTROL METHOD FOR VARIABLE COMPRESSION RATIO INTERNAL COMBUSTION ENGINES

TECHNICAL FIELD

The present invention relates to a control of a variable-compression-ratio internal combustion engine equipped with a variable compression-ratio mechanism.

BACKGROUND ART

In a case of variable compression-ratio mechanism adapted to change a compression ratio of the engine in accordance with a rotational position of a control shaft, a large load such as combustion load and inertia load is repeatedly applied to an actuator for driving the control shaft. Hence, Patent literature 1 discloses a previously proposed technique. In this technique, a speed reducer is interposed between the actuator and the control shaft, and thereby a torque by which the actuator holds the control shaft is lightened so that consumption energy of the actuator is reduced when the engine compression ratio is maintained constant.

CITATION LIST

Patent Literature

Patent Literature 1: Japanese Patent No. 4533856

SUMMARY OF THE INVENTION

Problem to be Solved

In ordinary driving patterns such as a city driving, an operating state where the engine compression ratio is maintained constant (i.e., compression-ratio unchanged state) tends to be used more frequently than an operating state where the engine compression ratio is changed. In the case that the operating state where the compression ratio is maintained constant is frequently used, an input shaft of the speed reducer is not rotated (in a stopped state) for a long time. As a result, there is a risk that insufficient lubrication is caused to incur a partial wear.

It is therefore an object of the present invention to resolve or ease a problem of insufficient lubrication even if the input shaft of the speed reducer is not rotated (in a stopped state) for a long time because of the compression-ratio unchanged state.

Solution to Problem

A variable-compression-ratio internal combustion engine according to the present invention comprises a variable compression-ratio mechanism configured to vary a compression ratio of the internal combustion engine in accordance with a rotational position of a control shaft; an actuator configured to drive the control shaft; a speed reducer provided between the actuator and the control shaft and configured to reduce in speed a rotational power of the actuator and transmit the speed-reduced rotational power to the control shaft; and a speed-reducer accommodating case accommodating the speed reducer.

An input shaft of this speed reducer which is connected to the actuator has a shaft center line extending along a horizontal direction, and at least a part of the input shaft is kept under a lubricating oil retained in the speed-reducer accommodating case. The input shaft of the speed reducer is swung by a predetermined swing angle during a predetermined operating state where the compression ratio of the internal combustion engine is maintained constant.

Preferably, the swing angle is larger than or equal to an angle level which soaks an entire circumferential portion of the input shaft of the speed reducer into the lubricating oil retained in the speed-reducer accommodating case. Also, the swing angle is set such that a swing angle of the control shaft is not allowed to generate a substantive change of the compression ratio.

Effects of Invention

According to the present invention, during the predetermined operating state in which the compression ratio of the engine is maintained constant, the input shaft of the speed reducer is swung by a predetermined swing angle. Hence, the input shaft of the speed reducer is swung under the state where some part of the input shaft is under the lubricating oil retained in the speed-reducer accommodating case. With this swing motion of the input shaft, lubricating oil is supplied also to an outer circumferential surface of remaining part of the input shaft which is located above the lubricating oil retained in the speed-reducer accommodating case. Accordingly, a lubrication performance for the input shaft of the speed reducer can be improved. Because not all of the input shaft of the speed reducer needs to be soaked into the lubricating oil, an amount of the lubricating oil which should be retained in the speed-reducer accommodating case can be suppressed. For example, the capacity of an oil pump that supplies lubricating oil into the speed-reducer accommodating case can be reduced.

Moreover, in a case that a speed reduction ratio of the speed reducer is set at a sufficiently great value, an output shaft of the speed reducer which is connected to the control shaft is rotated by a sufficiently small angle when the input shaft of the speed reducer is swung by the predetermined swing angle. Therefore, the compression ratio of the engine does not fluctuate unnecessarily.

DETAILED DESCRIPTION OF INVENTION

Figure 1:
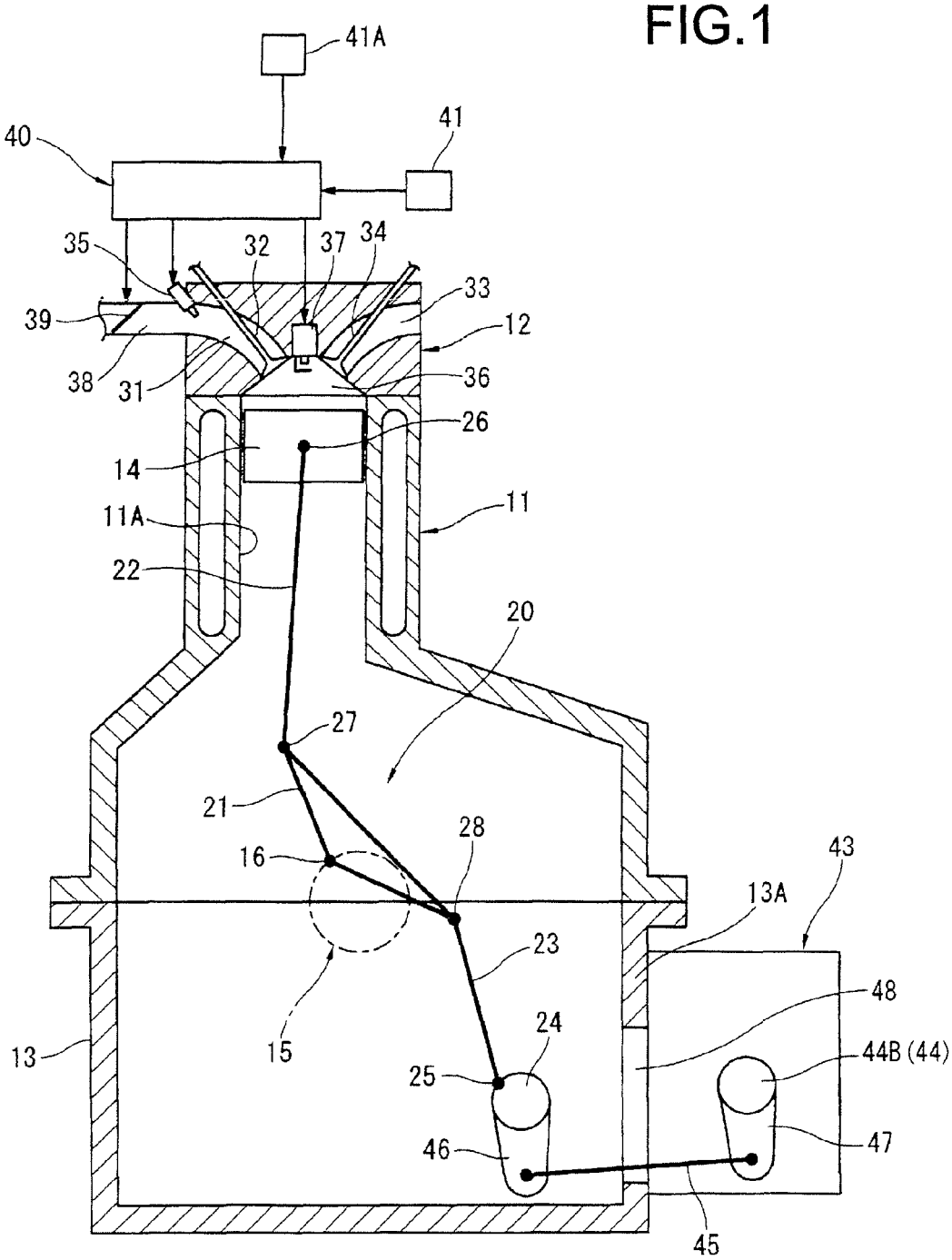
FIG. 1 A schematic configuration view illustrating a control device for a variable-compression-ratio internal combustion engine according to an embodiment of the present invention.

Hereinafter, preferred embodiments according to the present invention will be explained in detail referring to the drawings. As shown in FIG. 1, a cylinder head 12 is fixed or fastened to an upper part of a cylinder block 11 of an internal combustion engine. On the other hand, an oil-pan upper member 13 which constitutes an upper portion of an oil pan is fixed to a lower part of the cylinder block 11. An oil-pan lower member (not shown) which constitutes a lower portion of the oil pan is fixed to a lower part of the oil-pan upper member 13. A piston 14 is fitted into each cylinder 11A of the cylinder block 11 such that the piston 14 is slidable in the cylinder 11A. The piston 14 is linked to a crank pin 16 of a crank shaft 15 by a variable compression-ratio mechanism 20 which utilizes a multi-link-type piston-crank mechanism. It is noted that only link center lines of respective linking components which constitute the variable compression-ratio mechanism 20 are schematically illustrated in FIG. 1 for purpose of simplicity.

The variable compression-ratio mechanism 20 includes a lower link 21, an upper link 22, a control shaft 24, a control eccentric shaft portion 25 and a control link 23. The lower link 21 is rotatably attached to the crank pin 16 of the crank shaft 15. The upper link 22 connects the lower link 21 with the piston 14. The control shaft 24 is rotatably supported by the cylinder block 11, the oil-pan upper member 13 or the like (i.e., supported by an engine main-body member). The control eccentric shaft portion 25 is provided to be eccentric (deviated) with respect to the control shaft 24. The control link 23 connects the control eccentric shaft portion 25 with the lower link 21. The piston 14 is rotatably connected with an upper end of the upper link 22 through a piston pin 26. The lower link 21 is rotatably connected with a lower end of the upper link 22 through a first connecting pin 27. The lower link 21 is rotatably connected with an upper end of the control link 23 through a second connecting pin 28. A lower end of the control link 23 is rotatably attached to the control eccentric shaft portion 25.

The control shaft 24 is connected through an after-mentioned speed reducer 44 to a variable compression-ratio motor 30 (see FIG. 2) which functions as an actuator. The variable compression-ratio motor 30 varies a rotational position of the control shaft 24, so that an attitude (posture) of the lower link 21 is varied. Thereby, a piston stroke characteristic having a piston top-dead-center position and a piston bottom-dead-center position is varied to vary a compression ratio of the engine. It is noted that the actuator which is used in this embodiment is not limited to the electric motor 30, and may be a hydraulically-powered actuator.

Moreover, an intake valve 32, an exhaust valve 34, an fuel-injection valve 35 and a spark plug 37 are installed in the cylinder head 12 of the internal combustion engine. The intake valve 32 functions to open and close an intake port 31, and the exhaust valve 34 functions to open and close an exhaust port 33. The fuel-injection valve 35 injects fuel into the intake port 31. The spark plug 37 ignites (sparks) air-fuel mixture within a combustion chamber 36. Moreover, a throttle valve 39 for adjusting an amount of intake air is provided in an intake passage 38.

A control section 40 is a digital computer system which has functions of memorizing and executing various engine controls. The control section 40 controls fuel injection timing, fuel injection quantity, ignition timing, intake-air amount (throttle opening degree) and the like, by controllably driving the fuel-injection valve 35, the spark plug 37, the throttle valve 39 and the like, on the basis of signals derived from various sensors and the like such as an oil temperature sensor 41. Additionally, the control section 40 controls the compression ratio of the engine by controllably driving the variable compression-ratio motor 30 in accordance with an operating state of the engine.

Each of the cylinder block 11 and the oil-pan upper member 13 is a part of an engine main body. The control shaft 24 of the variable compression-ratio mechanism 20 is rotatably accommodated (received) in the engine main body constituted by the cylinder block 11, the oil-pan upper member 13 and the like. On the other hand, the speed reducer 44 and the variable compression-ratio motor 30 are attached to an outer wall of the oil-pan upper member 13 through a speed-reducer accommodating case 43 provided for accommodating the speed reducer 44. In detail, the speed reducer 44 and the variable compression-ratio motor 30 are attached through the speed-reducer accommodating case 43 to an intake-side lateral wall 13A of the oil-pan upper member 13. It is noted that the speed-reducer accommodating case 43 may be fixed to the other lateral wall of the engine main body such as a lateral wall of the cylinder block 11 although the speed-reducer accommodating case 43 is fixed to the oil-pan upper member 13 in this example.

The control shaft 24 is connected through a lever 45 to an output shaft 44B of the speed reducer 44 located inside the speed-reducer accommodating case 43. Specifically, one end of the lever 45 is connected with a tip of a first arm 46 such that a relative rotation between the lever 45 and the first arm 46 is possible whereas another end of the lever 45 is connected with a tip of a second arm 47 such that a relative rotation between the lever 45 and the second arm 47 is possible. The first arm 46 is formed to extend from an axially center portion of the control shaft 24 in a radially outer direction of the control shaft 24. The second arm 47 is formed to extend from a tip of the output shaft 44B in a radially outer direction of the output shaft 44B. The intake-side lateral wall 13A of the oil-pan upper member 13 to which the speed-reducer accommodating case 43 is fastened is formed with a lever slit 48 which passes through the intake-side lateral wall 13A. The lever 45 is inserted into the lever slit 48.

Figure 2:
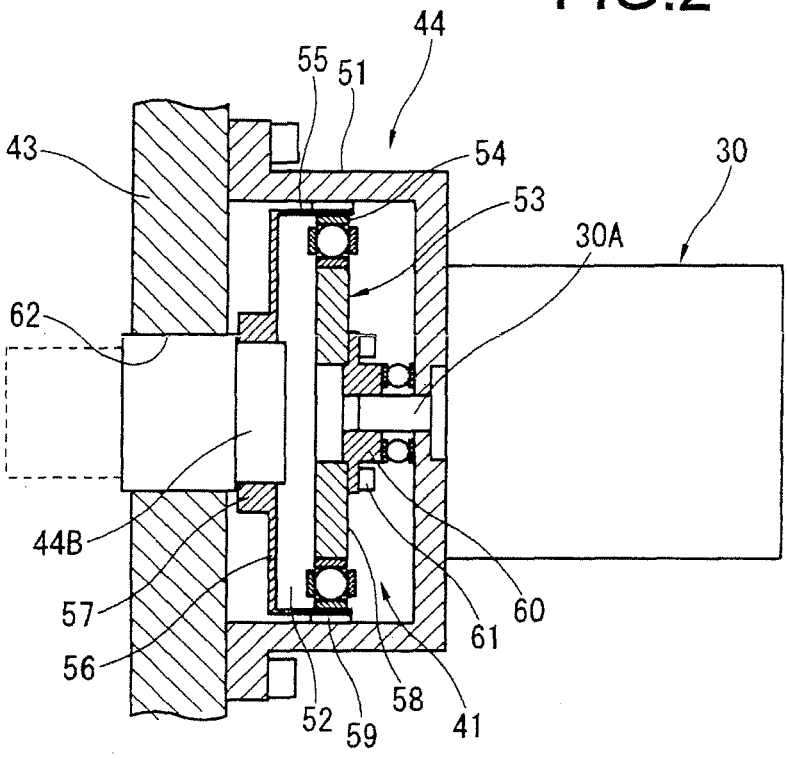
FIG. 2 A sectional view illustrating an area near bearing portions of a speed reducer according to the embodiment.
Figure 3:
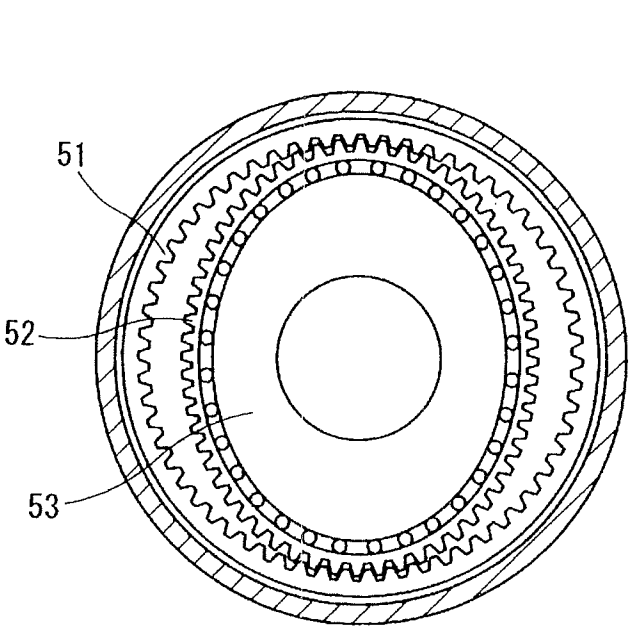
FIG. 3 (*a*) An exploded obliquely-perspective view illustrating the speed reducer according to the embodiment. (*b*) A corresponding sectional view of the speed reducer.
Figure 3:
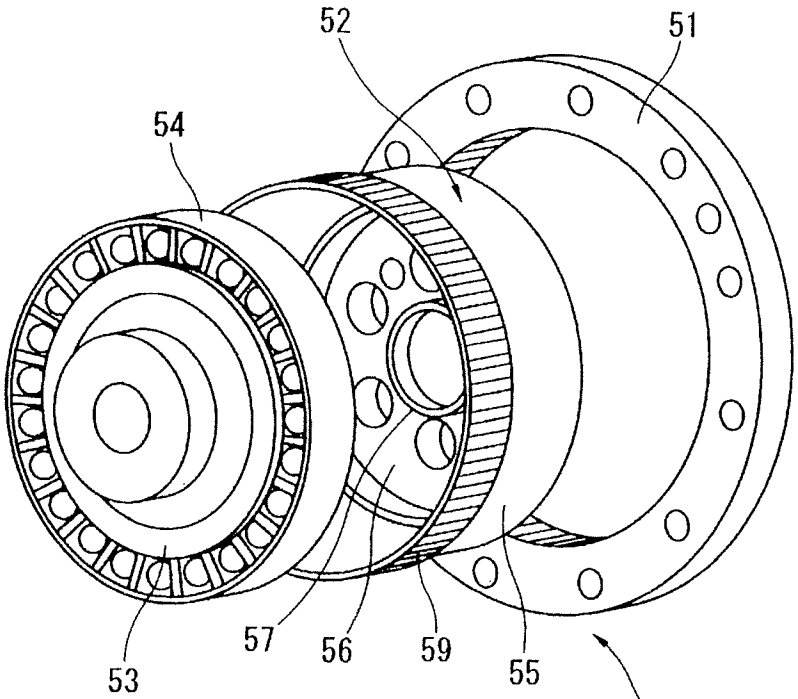

Referring to FIGS. 2 and 3, a structure of the speed reducer 44 will now be explained. The speed reducer 44 utilizes a strain wave gearing (harmonic drive gearing). A structure of the strain wave gearing is known as disclosed in Japanese Patent Application Publication No. 2009-41519. Hence, a brief explanation of the strain wave gearing is as follows. The speed reducer 44 includes an annular internal gear 51, a flexible external gear 52, and a wave generator 53. The flexible external gear 52 is formed in a cup shape, and concentrically disposed inside the internal gear 51. An outer-race member 54 having an elliptical outline is attached to the wave generator 53. The flexible external gear 52 includes a body portion 55, a diaphragm 56, a boss 57, and external teeth 59. The body portion 55 is formed in a cylindrical-tube shape. The diaphragm 56 closes one end of the tubular body portion 55. The boss 57 is integrally molded with the diaphragm 56 at a center portion of the diaphragm 56. The external teeth 59 are formed in an outer circumferential surface of the body portion 55 at a location near an opening portion 58 of the body portion 55, and mesh with internal teeth of the internal gear 51.

The body portion 55 of the flexible external gear 52 is in a circular-tube shape before the wave generator 53 is inserted into the body portion 55. However, a portion of body portion 55 which is near the opening portion 58 is deformed (bent) in an elliptical-tube shape when the wave generator 53 is inserted into the body portion 55. As shown in FIG. 3(*b*), this portion of the body portion 55 is outwardly deformed in a major (longer) axis direction of the elliptical shape, and also inwardly deformed in a miner (shorter) axis direction of the elliptical shape. Accordingly, the flexible external gear 52 meshes with the internal gear 51 only at two parts which are located near the major axis of the elliptical shape and which are opposed to each other through a center of the wave generator 53. An outer circumference of the wave generator 53 is covered by the ring-shaped outer-race member 54. Hence, the wave generator 53 elastically deforms the flexible external gear 52 in its radial direction along an elliptical profile of the wave generator 53 such that the outer-race member 54 does not slide on the flexible external gear 52 in a rotational direction of the wave generator 53 when the wave generator 53 rotates.

A shaft center portion of the wave generator 53 is fixed to an output shaft 30A of the motor 30 through a hub 60 and bolts 61 such that the wave generator 53 rotates integrally with the output shaft 30A. The wave generator 53 constitutes an input shaft of the speed reducer 44. On the other hand, the output shaft 44B of the speed reducer 44 is connected through the lever 45 to the control shaft 24, as mentioned above. Moreover, the output shaft 44B is fixed to the boss 57 of the flexible external gear 52 such that the output shaft 44B rotates integrally with the flexible external gear 52. The output shaft 44B is rotatably supported by a bearing portion 62 of the speed-reducer accommodating case 43.

The number of external teeth of the flexible external gear 52 is different from the number of internal teeth of the internal gear 51 (for example, by only two teeth). Accordingly, the flexible external gear 52 rotates in a degree corresponding to the difference of the teeth number between the flexible external gear 52 and the internal gear 51 when the wave generator 53 rotates as the input shaft of the speed reducer 44. Thereby, a great speed-reduction ratio (e.g. equivalent to a few hundreds) can be obtained. It is noted that the speed reducer 44 operates as a speed-reducing mechanism when the motor 30 drivingly rotates the control shaft 24, whereas the speed reducer 44 operates as a speed-increasing mechanism when torque of the control shaft 24 rotates the motor 30.

According to the present invention, the speed reducer 44 is not limited to the unit constituted by the strain wave gearing (harmonic drive gearing) as in this embodiment, and may be the other type of rotational-speed reducer.

Figure 4:
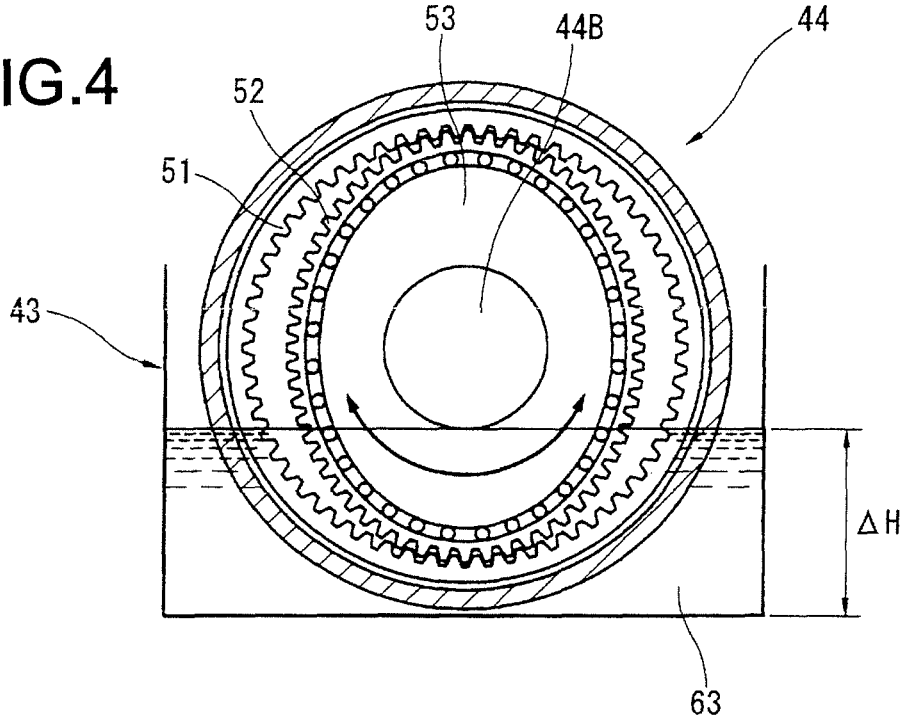
FIG. 4 An explanatory view illustrating a state where a part of an input shaft of the speed reducer according to the embodiment is kept under lubricating oil retained within a case.

As schematically shown in FIG. 4, lubricating oil 63 is supplied into the speed-reducer accommodating case 43 from an inside of the engine main body through the slit 48 and oil passages (not shown), for purpose of lubricating bearing portions and a gear-meshing portion of the speed reducer 44. When the engine is in operation, a predetermined quantity of the lubricating oil 63 is retained and kept inside the speed-reducer accommodating case 43.

An oil-surface height (oil level)ΔH of the lubricating oil 63 which is retained inside the speed-reducer accommodating case 43 when the engine is in operation can be set properly according to specifications. As the oil-surface height ΔH is set at a larger value, lubrication performance becomes more improved. However, in the case that the oil-surface height ΔH is set at a large value, an oil pump is required to be upsized with an increase of oil-agitating resistance, resulting in a risk of reduction of fuel economy. Therefore, in this embodiment, the oil-surface height ΔH of the lubricating oil 63 which is retained inside the speed-reducer accommodating case 43 during operations of the engine is set at a degree (value) at which a part of the wave generator 53 (functioning as the input shaft of the speed reducer 44), namely, a region smaller than a lower half of the wave generator 53 is covered with the lubricating oil 63. That is, the oil-surface height ΔH is set such that the region smaller than the lower half of the wave generator 53 is kept under the lubricating oil 63 when the engine is in operation.

The input shaft (wave generator 53) and the output shaft 44B of the speed reducer 44 are placed such that an axis (shaft center line) of the input shaft (wave generator 53) and an axis (shaft center line) of the output shaft 44B extend in a horizontal direction with respect to gravity. At least a part of the input shaft (wave generator 53) is constantly covered with the lubricating oil retained within the speed-reducer accommodating case 43. Also, at least a part of the output shaft 44B is constantly covered with the lubricating oil. Accordingly, when the compression ratio of the engine is changed, entire circumferences of the input shaft (wave generator 53) and the output shaft 44B are soaked into the lubricating oil 63 retained inside the speed-reducer accommodating case 43 by rotations of the input shaft (wave generator 53) and the output shaft 44B. Hence, a desired lubricating performance can be secured even though the oil-surface height ΔH is relatively low as mentioned above.

However, in an operating state where the compression ratio of the engine is maintained constant (compression-ratio unchanged state), the lubricating oil does not reach a portion located higher than the oil-surface height ΔH. If this operating state where the compression ratio is maintained continues for a long time, there is a risk that inadequate lubrication is caused. Therefore, in this embodiment, during the state where the compression ratio of the engine is maintained at a constant value, i.e. at the time of compression-ratio unchanged state, the input shaft (wave generator 53) of the speed reducer 44 is swung (rotated in a swinging manner) by a predetermined swing angle α (over a swing angular range α) for purpose of improving the lubrication performance.

Figure 5:
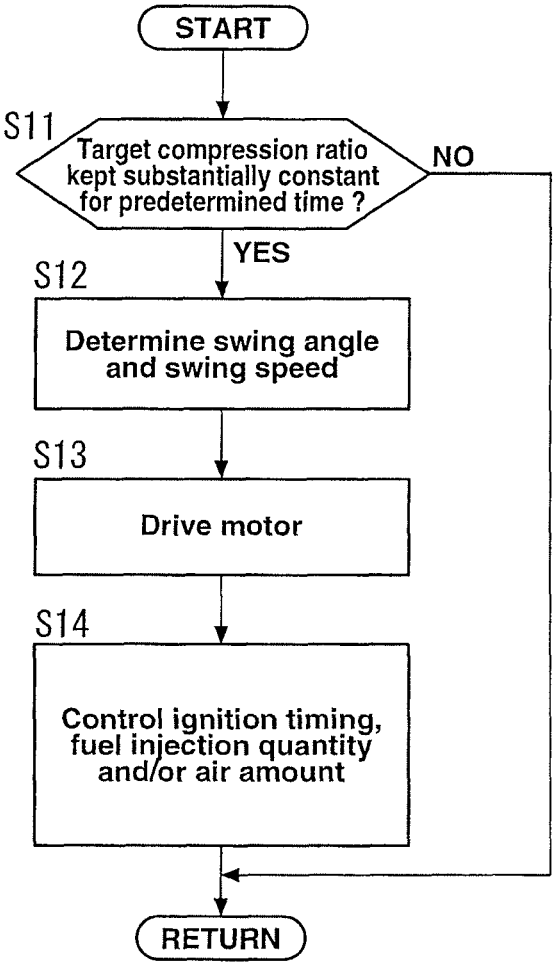
FIG. 5 A flowchart illustrating a control flow according to the embodiment.

FIG. 5 is a flowchart showing such a control flow in this embodiment. At step S11, it is judged whether or not the engine is in the predetermined operating state where the compression ratio of the engine is maintained constant. Specifically for example, in this embodiment, it is judged whether or not a target compression ratio has been within a predetermined range (i.e. at a substantially constant level) for a predetermined amount of time. That is, it is judged whether or not the predetermined amount of time has elapsed under the state where the target compression ratio falls within the predetermined range. The target compression ratio is set according to an engine load and an engine rotational speed. In detail, when the engine rotational speed and the engine load are low, the target compression ratio is set at a relatively high compression ratio in order to improve the fuel economy. On the other hand, when the engine rotational speed and the engine load are high, the target compression ratio is set at a relatively low compression ratio in order to avoid a knocking.

If it is determined that the engine is not in the operating state where the compression ratio is maintained constant at step S11, this routine is terminated. If it is determined that the engine is in the operating state where the compression ratio is maintained constant, the program proceeds to step S12. At step S12, a swing angle and a swing speed of the input shaft of the speed reducer 44 are determined based on the engine operating state. Concrete setting procedure for the swing angle and the swing speed will be mentioned later.

At step S13, the motor 30 is controllably driven such that the input shaft of the speed reducer 44 is swung by the swing angle (i.e. over the swing angular range) and at the swing speed which were set at step S12.

At step S14, a correction control is performed in such a manner that at least one of the ignition timing, the fuel injection quantity and the intake-air amount is corrected to suppress a torque fluctuation of the engine which is caused due to the swing motion of the input shaft of the speed reducer 44. It is noted that there is no need to perform this correction control of step S14 in a case that the torque fluctuation of the engine which is caused by the swing motion of the input shaft of the speed reducer 44 poses little problem.

Representative configurations and advantageous effects according to such embodiments shown in the drawings will now be listed.

[1] The wave generator 53 functioning as the input shaft of the speed reducer 44 is disposed such that the axis (shaft center line) of the input shaft (wave generator 53) extends along the horizontal direction, i.e. substantially parallel to the horizontal direction with respect to gravity. When the engine is in operation, at least a part of the input shaft (wave generator 53) is kept under the lubricating oil retained within the speed-reducer accommodating case 43. When the engine becomes in a predetermined compression-ratio-unchanged state where the compression ratio of the engine is maintained constant, the input shaft of the speed reducer 44 is swung by the predetermined swing angle.

Accordingly, while the compression ratio is maintained at a constant value, a portion of the input shaft of the speed reducer 44 which is located higher than the oil-surface height ΔH (i.e., a portion kept above the lubricating oil 63 if it were not for the swing motion) is sequentially soaked into the lubricating oil 63 together with the swing motion of the input shaft of the speed reducer 44. Hence, the lubrication performance for the input shaft of the speed reducer 44 can be improved even though a quantity of the lubricating oil is relatively small. Moreover, because not all of the input shaft of the speed reducer 44 needs to be soaked into the lubricating oil, the oil quantity (oil-surface height ΔH) of the lubricating oil which is retained inside the speed-reducer accommodating case 43 can be suppressed. For example, an oil pump which supplies lubricating oil into the speed-reducer accommodating case can be reduced in capacity. Also, the agitating resistance of lubricating oil is suppressed so that a consumption energy is saved. Because the speed reduction ratio of the speed reducer 44 is a sufficiently great value, the output shaft 44B of the speed reducer 44 which is connected to the control shaft is rotated by a very slight angle when the input shaft of the speed reducer 44 is swung by the above-mentioned predetermined swing angle. Therefore, an unnecessary variation of the compression ratio of the engine can be suppressed or avoided.

[2] The above-mentioned swing angle is larger than or equal to an angle level which soaks the entire circumferential portion of the input shaft of the speed reducer 44 into the lubricating oil retained within the speed-reducer accommodating case 43. Accordingly, the input shaft of the speed reducer 44 is soaked into the lubricating oil over entire periphery of the input shaft when the swing motion is performed. Hence, lubricating oil can be evenly supplied to all around the input shaft of the speed reducer 44 so that there is no region to which lubricating oil is not fed. Therefore, the lubrication performance can be improved.

[3] The swing angle is controlled according to the operating state of the engine as mentioned in the following items [4] to [9]. Hence, the lubrication performance for the input shaft of the speed reducer can be properly improved according to the operating state of the engine, while inhibiting an excessive swing motion.

[4] For example, the quantity (oil level) of lubricating oil within the speed-reducer accommodating case 43 is detected by an oil-quantity sensor 41A (oil-quantity obtaining means). Alternatively, the oil quantity is estimated based on the operating state of the engine. According to this oil quantity, the swing angle (swing angular range) is adjusted. Specifically, when the oil quantity decreases, the swing angle is increased because also the oil-surface height ΔH decreases. Thereby, the lubrication performance can be ensured. On the other hand, when the oil quantity increases, the swing angle is reduced. Thereby, an excessive swing motion can be suppressed to save the consumption energy.

[5] Moreover, the swing angle is adjusted according to a load of the speed reducer 44 by detecting or estimating the load of the speed reducer 44 (by way of speed-reducer-load obtaining means). Specifically, the swing angle is set at a larger value so as to supply lubricating oil more aggressively, as the load of the speed reducer 44 becomes higher. This is because a lubrication condition becomes strict as the load of the speed reducer 44 becomes higher. Accordingly, the desired lubrication performance can be secured.

[6] When the temperature of the motor 30 exceeds a predetermined level, there is a high possibility that an efficiency of the motor 30 has been reduced, or the motor 30 has been demagnetized. Hence, at this time, the swing angle is reduced so as to suppress a power consumption of the motor 30.

[7] When the oil temperature of the lubricating oil which is detected by the oil temperature sensor 41 exceeds a predetermined level, a viscosity of the lubricating oil is reduced resulting in a reduction of oil-film retentivity. Hence, at this time, the swing angle is increased to ensure the lubrication performance.

[8] In a case that the compression ratio of the engine is low, the compression ratio is less influenced by a rotation angle (rotational change) of the control shaft 24 as compared with a case that the compression ratio is relatively high. Moreover, in a high-load-side driving region in which the compression ratio is set at a relatively low value, a requirement for lubrication is strict. Therefore, as the compression ratio of the engine becomes lower, the swing angle is more increased so that a feed quantity of lubricating oil is increased. Accordingly, the lubrication performance can be improved.

[9] When oil pressure decreases, a discharge rate of the oil pump decreases to lower the oil-surface height ΔH, and thereby there is a concern about inadequate lubrication. Therefore, when the oil pressure is lower than or equal to a predetermined pressure, the swing angle is increased in order to secure the lubrication performance. Accordingly, the inadequate lubrication which is caused due to the reduction of oil pressure can be avoided so that the desired lubrication performance is ensured.

[10] If the swing operation of the speed reducer continues without cease during the predetermined operating state where the compression ratio of the engine is kept constant, abrasion (wear) of the bearing portions and the like is promoted. In such a case, there is a risk that durability and lifetime thereof are reduced. Therefore, preferably, the swing of the speed reducer and a suspend (stop) of this swing are alternately repeated, during the predetermined operating state where the engine compression ratio is kept constant. That is, the swing motion of the speed reducer is periodically performed at a predetermined interval (with a predetermined period).

[11] More preferably, this predetermined interval for the swing is set at a shorter value as the engine load becomes higher, in order to suppress the generation of partial wear.

[12] In the case that the input shaft of the speed reducer 44 is swung during the compression-ratio-unchanged state where the engine compression ratio is maintained constant, the speed reducer 44 is swung at a speed level lower than or equal to a predetermined speed. Accordingly, a frequency at which the input shaft of the speed reducer inputs load into the bearing portions is suppressed, so that the durability is improved.

[13] Preferably, the control section 40 (swing-speed control means) increases the swing speed more as the load of the speed reducer becomes higher. Accordingly, the generation of partial wear can be suppressed or prevented at the time of load application to specific sites.

[14] Preferably, in a case that there is a risk that the engine compression ratio unnecessarily fluctuates to cause the fluctuation of engine torque at the time of swing motion of the input shaft of the speed reducer, for example, in a case that a speed-change ratio (speed reduction ratio) of the speed reducer is small; at least one of the ignition timing, the fuel injection quantity and the intake-air amount is corrected based on the variation (fluctuation) of engine compression ratio which is caused by the swing motion, so as to suppress the fluctuation of engine torque. Accordingly, the fluctuation of engine torque can be suppressed more reliably, so that a drivability is improved.

[15] Moreover, in a case that the vehicle is equipped with a continuously variable transmission, a transmission ratio (speed ratio) of the continuously variable transmission is corrected based on the variation of engine compression ratio which is caused by the swing motion, so as to suppress a fluctuation of output torque of the vehicle. Accordingly, the fluctuation of vehicle output torque can be suppressed so that the drivability is improved.

[16] Furthermore, the above-mentioned swing motion of the input shaft of the speed reducer may be produced only when the vehicle is in an idle state in which the torque fluctuation can be ignored.

The invention claimed is:

1. A control device for a variable-compression-ratio internal combustion engine, the control device comprising:

a variable compression-ratio mechanism including a control shaft and link connected to a crankshaft of the internal combustion engine, the variable compression-ratio mechanism being configured to vary a compression ratio of the internal combustion engine in accordance with a rotational position of the control shaft;

an actuator configured to drive the control shaft;

a speed reducer provided between the actuator and the control shaft and configured to reduce in speed a rotational power of the actuator and transmit the speed-reduced rotational power to the control shaft; and a speed-reducer accommodating case accommodating the speed reducer, wherein an input shaft of the speed reducer which is connected to the actuator has a shaft center line extending along a horizontal direction, at least a part of the input shaft is kept under a lubricating oil retained in the speed-reducer accommodating case, and the control device further comprises a control section configured to swing the input shaft of the speed reducer by a predetermined swing angle during a predetermined operating state where the compression ratio of the internal combustion engine is maintained constant.

2. The control device according to claim 1, wherein the swing angle is larger than or equal to an angle level which soaks an entire circumferential portion of the input shaft of the speed reducer into the lubricating oil retained in the speed-reducer accommodating case.

3. The control device according claim 1, wherein the control section is configured to control the swing angle in accordance with an operating state of the internal combustion engine.

4. The control device according to claim 3, wherein the control device further comprises an oil-quantity obtaining section configured to detect or estimate oil quantity of the lubricating oil retained in the speed-reducer accommodating case, and the control section is configured to increase the swing angle when the oil quantity decreases.

5. The control device according to claim 3, wherein the control device further comprises a speed-reducer-load obtaining section configured to detect or estimate a load of the speed reducer, and the control section is configured to set the swing angle at a larger value as the load of the speed reducer becomes higher.

6. The control device according to claim 3, wherein the actuator is a motor, and the control section is configured to reduce the swing angle when a temperature of the motor exceeds a predetermined level.

7. The control device according to claim 3, wherein the control device further comprises an oil-temperature detecting section configured to detect oil temperature of the lubricating oil, and the control section is configured to increase the swing angle when the oil temperature exceeds a predetermined level.

8. The control device according to claim 3, wherein the control section is configured to set the swing angle at a larger value as the compression ratio of the internal combustion engine becomes lower.

9. The control device according to claim 3, wherein the control section is configured to increase the swing angle when an oil pressure is lower than or equal to a predetermined level.

10. The control device according to claim 1, wherein the control section configured to repeatedly swing and stop the speed reducer such that the speed reducer is swung at a predetermined interval, during the predetermined operating state where the compression ratio of the internal combustion engine is maintained constant.

11. The control device according to claim 1, wherein the control section is configured to swing the speed reducer at a swing speed lower than or equal to a predetermined speed, during the predetermined operating state where the compression ratio of the internal combustion engine is maintained constant.

12. The control device according to claim 1, wherein at least one of an ignition timing, a fuel injection quantity and an intake-air amount is corrected to suppress a torque fluctuation of the internal combustion engine on the basis of the compression ratio of the internal combustion engine which is set by the variable compression-ratio mechanism, when the input shaft is swung.

13. A control method for a variable-compression-ratio internal combustion engine, the control method comprising:

providing a variable compression-ratio mechanism including a control shaft and a link connected to a crankshaft of the internal combustion engine, the variable compression-ratio mechanism being configured to vary a compression ratio of the internal combustion engine in accordance with a rotational position of the control shaft, an actuator configured to drive the control shaft, a speed reducer provided between the actuator and the control shaft, and configured to reduce in speed a rotational power of the actuator and transmit the speed-reduced rotational power to the control shaft, and a speed-reducer accommodating case accommodating the speed reducer;

placing the speed reducer such that an input shaft of the speed reducer which is connected to the actuator has a shaft center line extending along a horizontal direction;

keeping at least a part of the input shaft under a lubricating oil retained in the speed-reducer accommodating case; and swinging the input shaft of the speed reducer by a predetermined swing angle during a predetermined operating state where the compression ratio of the internal combustion engine is maintained constant.

* * * * *